US006776591B1

(12) United States Patent
Rinninger et al.

(10) Patent No.: US 6,776,591 B1
(45) Date of Patent: Aug. 17, 2004

(54) MEMBRANE PUMP COMPRISING AN INLET OPENING THAT IS CONTROLLED BY THE MEMBRANE

(75) Inventors: Gerhard Rinninger, Pforzen (DE); Oswald Seibold, Munich (DE)

(73) Assignee: ASF Thomas Industries GmbH, Puchheim (DE)

( * ) Notice: Subject to any disclaimer, the term of this patent is extended or adjusted under 35 U.S.C. 154(b) by 0 days.

(21) Appl. No.: 10/018,596

(22) PCT Filed: Apr. 28, 2000

(86) PCT No.: PCT/EP00/03857

§ 371 (c)(1),
(2), (4) Date: Mar. 14, 2002

(87) PCT Pub. No.: WO00/66891

PCT Pub. Date: Nov. 9, 2000

(30) Foreign Application Priority Data

Apr. 30, 1999 (DE) ..... 199 19 908

(51) Int. Cl.[7] ..... F04B 39/10; F04B 53/10

(52) U.S. Cl. ..... 417/571; 417/437; 417/477.12; 92/99; 92/140

(58) Field of Search ..... 417/571, 477.1, 417/2, 437, 477.12; 92/99, 140

(56) References Cited

U.S. PATENT DOCUMENTS 3,947,156 A * 3/1976 Becker ..... 417/437
5,275,541 A * 1/1994 Becker et al. ..... 417/413.1
5,785,508 A * 7/1998 Bolt ..... 417/560

* cited by examiner

*Primary Examiner*—Justin R Yu
*Assistant Examiner*—William H. Rodriguez
(74) *Attorney, Agent, or Firm*—Scully, Scott, Murphy & Presser

(57) ABSTRACT

A membrane pump (1) having a membrane (24) which can be actuated by a crank drive (32), which membrane bounds, together with a concave pump body surface (8), a pump chamber (38), an inlet channel (4) and an outlet channel (17) which open out at an inlet opening (9) and an outlet opening (20) in the pump body surface (8), the membrane (24) having a membrane core (25) and an elastically deformable membrane ring (26) and the membrane core (26) having a convex surface adapted to the pump body surface (8). The inlet opening (9) is arranged in the region of the pump body surface (8) which the membrane (24) first approaches upon an expulsion stroke of the crank drive (32), and the elastically deformable membrane ring (26) closes the inlet opening (9) before the attainment of top dead center of the crank drive (32).

8 Claims, 2 Drawing Sheets

MEMBRANE PUMP COMPRISING AN INLET OPENING THAT IS CONTROLLED BY THE MEMBRANE

BACKGROUND OF THE INVENTION

1. Field of the Invention

Figure 2:
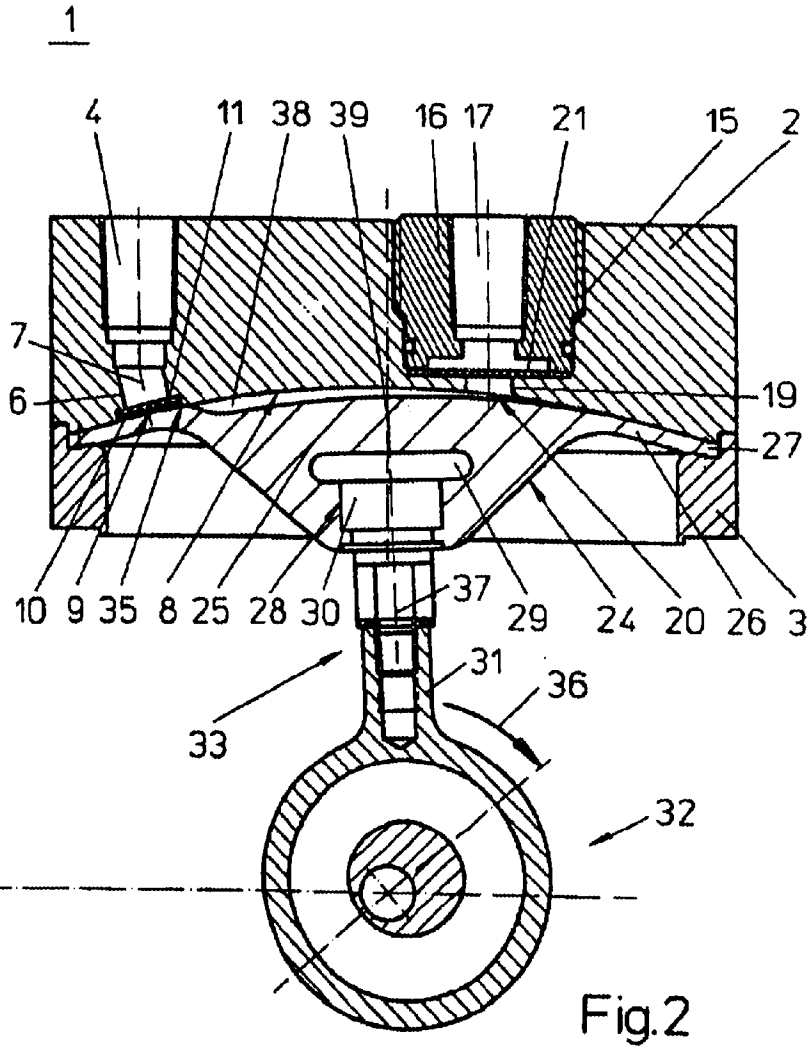

The invention proceeds from a membrane pump in accordance with the preamble of the main claim.

2. Discussion of the Prior Art

From German Utility Model G 94 06 216 there is known a membrane pump in accordance with the preamble of claim 1. The membrane pump of this utility model has a membrane which can be actuated by crank drive, which membrane is attached at an outer membrane circle ring to a pump body of a pump housing. Along with the outer membrane circle ring, the membrane has a membrane core which is connected with the outer membrane circle ring via an elastically deformable membrane ring. The membrane, with a pump body surface formed on the pump body, bounds a pump chamber (compression/expansion chamber). An inlet channel and an outlet channel are formed in the pump body, which open out at an inlet opening and an outlet opening in the pump body surface. The inlet channel and the outlet channel are, outside the pump body, preferably connected with directional valves, by means of which one direction of flow is predetermined through the inlet channel and the outlet channel. Upon a suction stroke of the crank drive, a pump medium is transported through the inlet channel into the pump chamber and upon a following expulsion stroke of the crank drive the pump medium is displaced out of the pump chamber via the outlet channel.

Disadvantageous with the membrane pump known from German Utility Model G 94 06 216 is that during the expulsion stroke a part of the pump medium located in the pump chamber is pressured back or compressed into the inlet channel. In particular in the case of a compressible pressure medium, for this reason the efficiency of the membrane pump significantly worsened. A further disadvantage is that the outlet opening is choked in dependence upon the stroke position of the crank drive, the choking increasing before attainment of the top dead center position of the crank drive, so that at the end of the expulsion stroke the highly compressed pump medium can increasingly poorly escape.

Summarizing, with the known membrane pump a quantity of pump medium corresponding to the compression ratio of the membrane pump cannot be completely expelled out of the pump chamber via the outlet opening. Further, the known membrane pump is suitable only to a limited degree for compressible pump mediums such as for example gases.

SUMMARY OF THE INVENTION

The object of the present invention is to propose a membrane pump which avoids the disadvantages of the state of the art and allows a compression ratio of the pump medium located in the pump chamber which is as great as possible.

The object is achieved by means of the membrane pump in accordance with the invention having the characterizing features of the main claim. Advantageous developments of the invention are indicated in the subclaims.

The membrane pump in accordance with the invention has the advantage that the inlet opening of the inlet channel is already closed during the explosion stroke of the crank drive, so that a further compression of a pump medium takes place only in the pump chamber and the pump medium can be expelled completely via the outlet channel.

It is advantageous when the middle point of the inlet opening lies at least approximately in the plane of rotation of the crank of the crank drive. By these means, the inlet opening of the inlet channel is closed at a particularly early time point.

It is advantageous when a surrounding control edge is formed in the edge region of the inlet opening, on which control edge the elastically deformable membrane ring closes the inlet opening. By these means the inlet opening is reliably closed on all sides.

In an advantageous manner, the elastically deformable membrane ring closes the inlet opening with a crank rotary position of the crank drive which is up to 90° before top dead center. By these means, from a maximum deflection of the membrane of the membrane pump, sealing off is attained.

In advantageous manner, the elastically deformable membrane ring closes the inlet opening at a crank rotary position of the crank drive which lies 20° to 90° before top dead center. By these means a sealing of the inlet opening of the inlet channel is attained from a maximum deflection of the membrane of the membrane pump, whereby with a closed inlet opening of the inlet channel a part of the crank rotation is available in order to attain a greater compression of the pump medium.

It is of advantage when a valve plate is arranged in a region of the inlet opening of the inlet channel for forming a directional valve. In that the valve plate is arranged directly at the inlet opening of the inlet channel, the dead volume of the inlet channel can be further reduced. Thereby it is particularly advantageous when the middle axis of the inlet channel is orientated perpendicularly to the pump body surface. By these means the structural configuration of the directional valve and the emplacement of the valve plate in the inlet channel is simplified.

In an advantageous manner, the outlet opening of the outlet channel is arranged in a region of the pump body surface which the membrane last approaches and which is attained by the membrane at the earliest with the top dead center position of the crank drive. Thereby it is achieved that the pump medium can be pumped out of the pump chamber into the outlet channel as far as possible unchoked. Further, it is achieved that the outlet opening of the outlet channel is not already closed before the attainment of the top dead center position of the crank drive.

It is of advantage when the middle point of the outlet opening of the outlet channel is arranged in an inner region of the pump body surface which lies opposite to a membrane core of the membrane. Since upon the crank movement of the crank drive, the pump medium is pumped last out of the region the pump chamber arranged above the membrane core of the membrane, as a result of the movement of the membrane core, the outlet opening of the outlet channel is thereby particularly favourably arranged.

BRIEF DESCRIPTION OF THE ACCOMPANYING DRAWINGS

Figure 1:
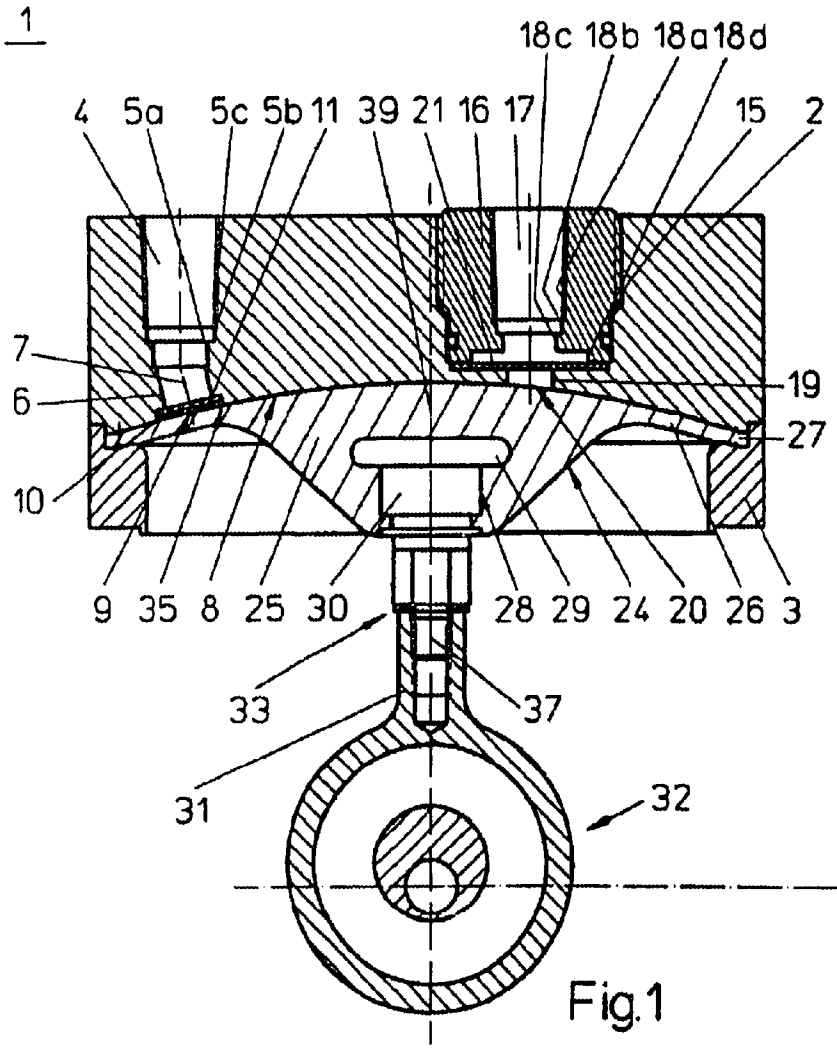
Figure 3:
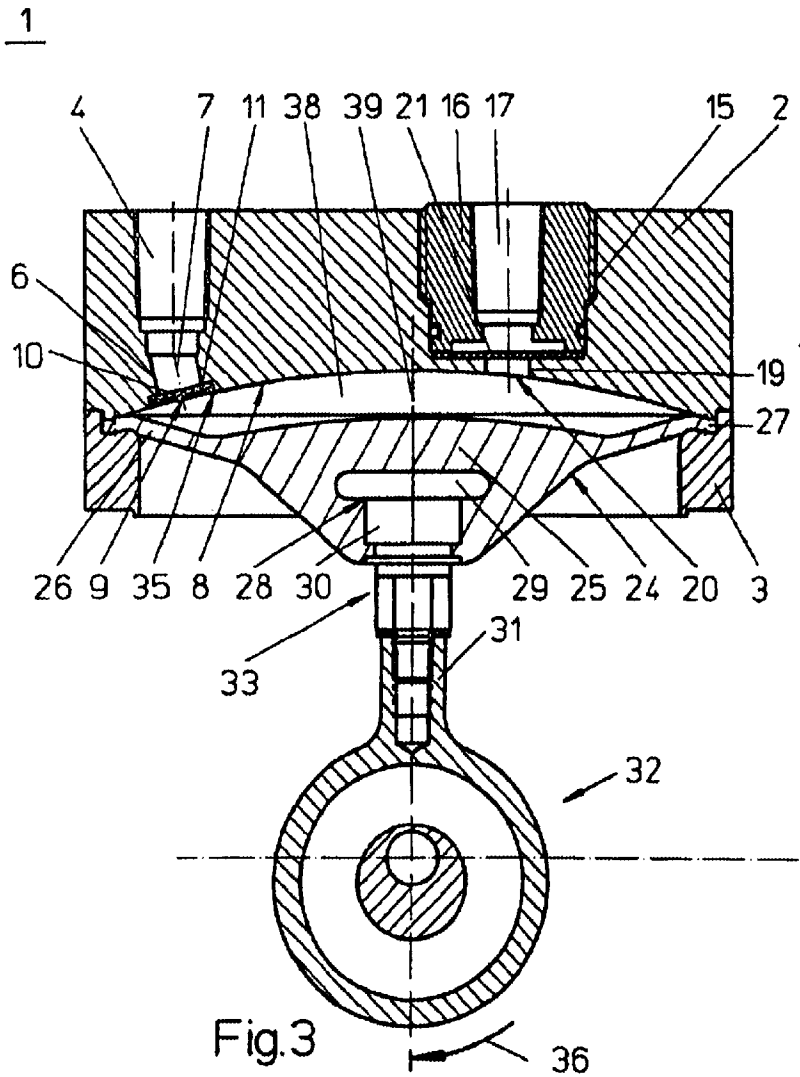

Exemplary embodiments of the invention are described in more detail in the following description and illustrated in a simplified manner in the drawings, which show:

FIG. 1 an axial section through an exemplary embodiment of a membrane pump in accordance with the invention, in the top dead center position of the crank drive;

FIG. 2 the exemplary embodiment in a crank rotary position which lies 50° after the top dead center position;

FIG. 3 the exemplary embodiment in the bottom dead center position; and

Figure 4:
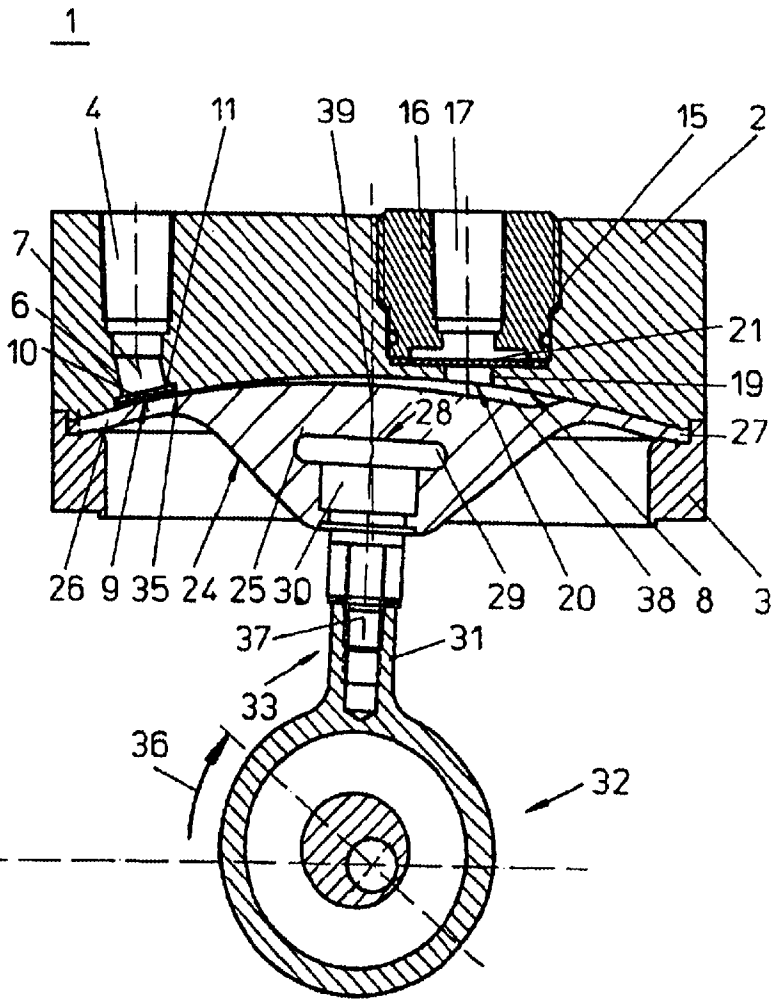

FIG. 4 the exemplary embodiment in a crank rotary position of the crank drive which lies 50° before the top dead center position.

DETAILED DESCRIPTION OF THE INVENTION

Description of the exemplary embodiments

FIG. 1 shows a partly sectional representation of the membrane pump 1 in accordance with the invention. The membrane pump 1 can in particular be employed as a vacuum pump or as a pressure pump for transporting pump media, e.g. liquids and gases. The membrane pump 1 in accordance with the invention is, however, suitable also for other applications.

The membrane pump 1 has a pump body 2 which is connected with a housing element 3. The pump body 2 has an inlet channel 4, which in this exemplary embodiment is formed by means of stepped bores 5*a*, 5*b*, 5*c* and an oblique bore 6. Thereby, a middle axis 7 of the oblique bore 6 of the inlet channel 4 as orientated perpendicularly to a pump body surface 8 formed on the pump body. The inlet channel 4 opens out at an inlet opening 9 in the pump body surface 8. The inlet opening 9 is arranged in an outer region of the pump chamber, i.e. in the vicinity of the mounting of the membrane in the pump body 2. Furthermore, the middle point of the inlet opening 9 advantageously lies in the turning or pivoting plane of the crank 31 of the crank drive 32. It is to be remarked that the pivot plane of the crank 31 coincides with the sectional plane of FIG. 1. By means of the arrangement of the inlet opening in an outer region of the pump chamber and in the pivot plane of the crank 31 there is attained an early closing of the inlet opening 9 upon expulsion of the pump medium out of the pump chamber by means of the membrane. From the point of early closure of the inlet opening 9, the pump medium is no longer transported via the inlet channel 4 into the pump chamber. The inlet channel is from this point in time no longer effective as undesired dead space. By these means there is thus obtained an improvement and optimization of the pump process.

In the region of the inlet opening 9, i.e. directed towards the pump chamber, there is arranged a directional or inlet valve. The inlet valve consists, in the illustrated exemplary embodiment, of a valve plate 10, which is arranged in the region of the inlet opening 9 of the inlet channel 4 for forming the directional valve or inlet valve 4. In the region of the inlet opening 9 the oblique bore 6 of the pump body 2 has a surrounding pocket directed towards the pump chamber, which pocket has a greater diameter than the oblique bore 6. The valve plate 10 bears on a surrounding edge 11 formed between the oblique bore 6 and the pocket. The valve plate 10 is aligned in substance with the pump body surface 8, at least whilst it is closed by the membrane, whereby there is provided between the surrounding groove in the oblique bore 6 and the pump body surface 8 a control edge 35. In other words, there is formed in the edge region of the inlet opening 9 a surrounding control edge 35 which projects slightly over the valve plate 8, on which control edge the membrane closes the inlet opening 9. The surrounding control edge 35 ensures, in an advantageous manner, that the inlet valve with the valve plate 10 is securely and reliably closed on all sides upon an expulsion stroke. The arrangement of the inlet valve with a valve plate 10 directly in the region of the inlet opening 9, and the direct closing of the inlet valve by means of the membrane in the case of an expulsion stroke, further reduces the undesired dead space upon an expulsion stroke and therewith contributes to a further increase of the efficiency and reliability of the pump.

In the pump body 2, an outlet element 16 is screwed in, at a thread 15, which outlet element has stepped bores 18*a* to 18*d*, which together with an outlet recess 19 form an outlet channel 17. The outlet element may also be inserted and fixed by means of screws. The outlet channel 17 opens out in an outlet opening 20 in the pump body surface 8. Between the outlet recess 19 and the bore 18*d* a directional valve is formed by means of a valve plate 21. The outlet valve with the valve plate 21 is arranged in the region of the outlet recess 19 directed towards the pump chamber, whereby a further improvement of the pump effect is attained. The outlet opening 20 is arranged offset from the edge of the pump chamber towards the middle such that the outlet opening 20 is closed as late as possible upon an expulsion stroke. In other words, the outlet opening 20 is arranged in a region which is last covered over by the membrane at the end of the outlet stroke.

Both the inlet valve having the valve plate 10 and also the outlet valve having the valve plate 21 are advantageously formed as freely movable valves, which switch with the slightest possible pressure differences, in order to avoid compression losses and thus an indirect increase in undesired dead space. The valves are not pre-biased in any direction by means of a mounting or connection, which would mean that additional forces for switching the valves would be necessary, but they are formed to be freely movable. So that however, after lifting from their valve seat, i.e. after opening, upon ending of the flow process, the valves are carried back to their respective seats as free from tensions as possible, there is provided an appropriately form valve holder device. Thereby it is important both in the case of the inlet valve and in the case of the outlet valve that the mountings of the valve plates 10 and 21 are tension free, i.e. in the vicinity of the closed valve position the valve is as tension free as possible, so that slight pressure differences suffice for closing and also for opening. Upon deflection, upon opening of the valve there arise tensions in the valve through which it is pre-biased in the direction towards the closed position. In the present exemplary embodiment there are provided for this purpose for the inlet valve two bolts having a thin retaining collar to both sides the inlet opening 9. The inlet valve has elongate or oval attachment bores, through which the bolts pass. Upon opening of the valve, the valve plate is thus movable along the bores and makes possible a bending out inwardly into the pump chamber. Similar is attained in the case of the outlet valve by means of the bore 18*d* in the outlet element 16. The bore 18*d* is preferably a surrounding groove which is formed in the outlet element 16 facing towards the seat of the valve plate 21 and makes possible for the valve plate 21 a free opening movement away from the pump chamber.

The membrane has a membrane core 25, an elastically deformable membrane ring 26 and an outer membrane circle ring 27, whereby the membrane 24 is attached to the outer membrane circle ring 27 between the pump body 2 and the housing element 3. In the non-mounted condition, the membrane is substantially flat and is so mounted between the pump body 2 and the housing element 3 that the membrane is pre-biased in the direction towards the pump body surface 8. For this purpose the membrane is mounted spherically tangentially, as can be recognized from FIGS. 1 to 4. For this purpose the concave pump body surface 8 is continued also into the region of the mounting of the membrane circle ring 27, so that at least in the outer region, i.e. in the region of the membrane circle ring 21, the membrane bears on the edge regions of the concave pump body surface 8. By these means there is also ensured a reliable closure of the inlet valve by means of the membrane. The spherical-tangential mounting of the membrane avoids the flat ring-shaped undesired dead space commonly present in the region of the membrane mounting with known pumps, which undesired space results from an insufficient flexibility of the membrane and the pressure build-up in the pump upon the outlet procedure and following therefrom the bulging of the membrane away from the pump chamber. The membrane pump in accordance with the invention is so conceived that the compression ratio, i.e. the ratio of maximum to minimum pump chamber volume, is optimized. Since the compression ratio is dependent in particular upon the minimum attainable pump chamber volume and thus is determined by how well the elastic membrane can close off the pump chamber, there is attained by means of the above described characteristic of the membrane pump in accordance with the invention an optimization in this regard. Further, by means of the arrangement and configuration of the inlet valve and the outlet valve, the volumes in the flow channels are minimized, so that a strongly improved pump effect is provided. A mold core 28 is vulcanized into the membrane core 25 of the membrane 24, which core has a plate-shaped section 21 and a cylinder-shaped section 30. Via a connection device 31, the cylinder-shaped section 30 of the mold core 28 is connected with a crank 31 of a crank drive 32.

As mentioned above, in the edge region of the inlet opening 9 there is formed a surrounding control edge 35, at which the elastically deformable membrane ring 26 closes the inlet opening 9.

In FIGS. 2 to 4 the exemplary embodiment of the membrane pump of FIG. 1 is illustrated with different crank rotary positions of the crank drive. By considering FIGS. 1 to 4 one after another an impression of the movement process of the membrane pump 1 can be obtained. Thereby, in FIG. 1 the crank rotary position of the membrane pump is shown at top dead center, in FIG. 2 50° after top dead center, in FIG. 3 at bottom dead center and in FIG. 4 50° before top dead center. Since the elements illustrated in FIGS. 2 to 4 correspond to the elements of FIG. 1, a repeat description will not be given.

In FIG. 2, the crank rotary position of the crank drive 32 is illustrated after a rotation of the crank drive 32 in a direction of rotation 36 by 50°. Thereby, the axis 37 of the membrane core is tilted with respect to the axis 39 of the concave pump body surface 8. Thereby the membrane core 25 first lifts from the pump body surface 8 on the side of the inlet opening 9, whereby in the region of the outlet opening 20 it initially remains in contact with the pump body surface 8. In this exemplary embodiment, the inlet opening 9 of the inlet channel 4 is, with the crank rotary position illustrated in FIG. 2, closed by the elastically deformable membrane ring 26 of the membrane 24. The membrane ring 26 and/or the pump body surface 8 may also be so formed that the inlet opening 9 of the inlet channel 4 is already open with the crank rotary position of the crank drive 32 shown in FIG. 2. In general, with a crank rotary position of the crank drive 32 which is 90° after top dead center, the inlet opening 9 of the inlet channel 4 is open. Due to the rotary crank movement of the crank drive 32, the membrane 24 lifts itself from the pump body surface 8, whereby a pump chamber 38 formed between the membrane 24 and the pump body surface 8 increases in size and after the opening of the inlet opening 9 of the inlet channel 4 a pump medium is sucked in out of the inlet channel 4 through the inlet opening 9 into the pump chamber 38. Upon sucking in of the pump medium out of the inlet channel 4 into the pump chamber 38, the pump medium flows through the directional valve formed by the valve plate 10. Likewise, in the outlet channel 17 there is formed by means of the valve plate 21 a directional valve so that pump medium present on the side of the sealing plate 21 away from the outlet opening 20 does not flow back into the pump chamber 38 upon a suction stroke of the crank drive 32.

In FIG. 3, the membrane pump 1 is illustrated at a bottom dead center position of the crank drive 32. With respect to the top dead center position of FIG. 1, the crank drive 32 of the membrane 1 has completed a rotation in the direction of rotation 36 by 180°. In this position there is provided a volume of the pump chamber 38 which is at least approximately maximum. The membrane 24 thus bears on only in the region of the outer membrane circle ring 27 at which the membrane is connected with the pump body 2 and the housing element 3. Thereby, the inlet opening 9 of the inlet channel 4 and the outlet opening 20 of the outlet channel 17 are completely open.

Following the rotary crank position of the membrane pump 1 shown in FIG. 3 there is an expulsion stroke of the membrane 24, whereby the pump medium in the pump chamber 38 is compressed and expelled out of the membrane pump 1 via the outlet opening 20 of the outlet channel 17. Thereby it is attained by means of the valve plate 10 that the pump medium does not flow back out of the pump chamber 38 into the inlet channel 4.

With increasing expulsion stroke, the membrane 24 approaches the pump body surface 8. In FIG. 4, there is shown a crank rotary position of the crank drive 32 which lies 50° before the top dead center of the rotary crank drive 32 illustrated in FIG. 1. Thereby, the axis 37 is tilted with respect to the axis 39 of the pump body surface 8, whereby the tilting is effected oppositely to the tilting in FIG. 2. Thereby the membrane 24 initially approaches the inlet opening 9 of the inlet channel 4, whereby in the illustrated rotary angle position of the crank drive 32 the inlet opening 9 is already closed by the elastically deformable membrane ring 26. Further, the pump chamber 38 is formed extending from the inlet opening to the outlet opening 20 of the outlet channel 17 so that the pump medium preferably collects in the region of the outlet opening 20 of the outlet channel 17 upon the further rotary movement of the crank drive 32, whereby a complete pumping out of the pump medium out of the pump chamber 38 into the outlet channel 17 is effected.

By means of the early closing of the inlet opening 9 of the inlet channel 4 with the membrane ring 26 it is achieved that a dead space in the inlet channel 4 adjoining the pump chamber 38 is closed, so that pump medium present in the inlet channel 4 is not further compressed due to the further expulsion stroke of the crank drive and the expulsion stroke can be exploited entirely for compressing the pump medium which is to be pumped out via the outlet channel 17. Thereby it is particularly advantageous when the valve plate 10 is positioned in the inlet channel 4 near to the inlet opening 9, since thereby even before closure of the inlet opening 9 with the membrane ring 26, the dead volume is reduced. The outlet opening 20 of the outlet channel 17 is, in this exemplary embodiment, arranged in the region of the pump body surface 8 which the membrane 24 approaches last and which is attained by the membrane 24 at the earliest at the top dead center of the crank drive 32. Thereby it is attained that the outlet opening 20 is closed only after the completed expulsion stroke of the crank drive 32. So that the outlet opening 20 is not partly closed by the membrane ring 26 of the membrane 24, and thus the pump medium flow of the pump medium upon pumping out into the outlet opening 17 is not additionally choked, it is particularly advantageous that the middle point of the outlet opening 20 of the outlet channel 17 is arranged in an inner region of the pump body surface 8 which lies opposite to the membrane core 25 of the membrane 24.

The invention is not restricted to the described exemplary embodiments.

What is claimed is:

1. A membrane pump including a membrane which is actuated by a crank drive, said membrane bounding in conjunction with a concave pump body surface, a pump chamber, an inlet channel and an outlet channel which open to respectively an inlet opening and an outlet opening formed in the pump body surface, said membrane having a membrane core and an elastically deformable membrane ring, said membrane core having a convex surface, which is conformed to the pump body surface, said inlet opening being arranged in a region of the pump body surface which the membrane initially approaches during an expulsion stroke of the crank drive and wherein the elastically deformable membrane ring closes the inlet opening before the reaching of top dead center by the crank drive, and wherein an inlet valve is provided which is arranged in the region of the inlet opening of the inlet channel, characterized in that in an edge region of the inlet opening, there is formed a surrounding control edge against which the elastically deformable membrane ring bears so as to close the inlet valve, wherein said surrounding control edge is formed as a recess inside the pump body surface and wherein said inlet valve is located at said recess.

2. The membrane pump according to claim 1, wherein the inlet valve includes a valve plate which covers over the inlet opening.

3. The membrane pump according to claim 1, wherein the middle point of the inlet opening is located at least approximately in the plane of rotation of the crank of said crank drive.

4. The membrane pump according to claim 1, wherein the elastically deformable membrane ring closes the inlet opening at a rotary cranking position of the crank drive which is at an angle of up to 90° before top dead center of the crank drive.

5. The membrane pump according to claim 4, wherein the elastically deformable membrane ring closes the inlet opening at a rotary cranking position of the crank drive which is at an angle within the range of about 20° to 90° before top dead center of the crank drive.

6. The membrane pump according to claim 1, wherein the middle axis of the inlet channel is oriented perpendicularly to the pump body surface.

7. The membrane pump according to claim 1, wherein the outlet opening of the outlet channel is located in a region of the pump body surface which is last approached by the membrane and which is reached earliest by the membrane at the top dead center of the crank drive.

8. The membrane pump according to claim 1, wherein the middle point of the outlet opening of the outlet channel is arranged in an inner region of the pump body surface which is located opposite to the membrane core of the membrane.

* * * * *